US006523606B1

(12) United States Patent
Dienhart et al.

(10) Patent No.: US 6,523,606 B1
(45) Date of Patent: Feb. 25, 2003

(54) HEAT EXCHANGER TUBE BLOCK WITH MULTICHAMBER FLAT TUBES

(75) Inventors: Bernd Dienhart, Köln (DE); Hans-Joachim Krauss, Stuttgart (DE); Hagen Mittelstrass, Bondorf (DE); Karl-Heinz Staffa, Stuttgart (DE); Christoph Walter, Stuttgart (DE); Jochen Schumm, Eberdingen (DE)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/536,099

(22) Filed: Mar. 24, 2000

(Under 37 CFR 1.47)

Related U.S. Application Data

(63) Continuation of application No. PCT/DE99/02128, filed on Jul. 9, 1999.

(30) Foreign Application Priority Data

Jul. 28, 1998 (DE) ..... 198 33 845

(51) Int. Cl.[7] ..... F28F 9/22
(52) U.S. Cl. ..... 165/144; 165/175
(58) Field of Search ..... 165/144, 145, 165/175

(56) References Cited

U.S. PATENT DOCUMENTS

| | | | | | |
|---|---|---|---|---|---|
| 1,957,779 | A | * | 5/1934 | Hoppes | 165/145 |
| 2,044,457 | A | * | 6/1936 | Young | 165/144 |
| 2,105,267 | A | * | 1/1938 | Robertson | 165/175 |
| 2,184,657 | A | | 12/1939 | Young | |
| 3,416,600 | A | * | 12/1968 | Fink | 165/175 |
| 4,175,308 | A | * | 11/1979 | Togashi | 165/175 |
| 4,213,640 | A | | 7/1980 | Miles | |
| 4,969,512 | A | * | 11/1990 | Hisao et al. | 165/175 |
| 5,099,576 | A | * | 3/1992 | Shinmura | 165/175 |
| 5,303,770 | A | * | 4/1994 | Dierbeck | 165/144 |
| 5,314,013 | A | | 5/1994 | Tanabe | |
| 5,383,517 | A | * | 1/1995 | Dierbeck | 165/144 |
| 5,915,470 | A | * | 6/1999 | Dierbeck | 165/144 |
| 6,161,614 | A | * | 12/2000 | Woodhull, Jr. et al. | 165/144 |
| 6,170,569 | B1 | * | 1/2001 | Dienhart et al. | 165/175 |
| 6,173,493 | B1 | * | 1/2001 | Dierbeck | 165/175 |

FOREIGN PATENT DOCUMENTS

| | | |
|---|---|---|
| DE | 196 49 129 | 5/1998 |
| EP | 0 373 102 | 6/1990 |
| EP | 0 838 641 | 4/1998 |
| FR | 2 558 043 | 1/1985 |

* cited by examiner

*Primary Examiner*—Denise L. Esquivel
*Assistant Examiner*—Terrell McKinnon
(74) *Attorney, Agent, or Firm*—Scott M. Confer

(57) ABSTRACT

A heat exchanger block includes a plurality of block units, located one behind the other, each having a plurality of stacked tube units with tube ducts extending transverse to the block depth and height. The tube ducts are connected at ends to associated collector ducts extending in the block height direction. The tube units can be formed from a multichamber flat tube. At least one collector-duct connection is provided between adjacent block units to form a meandering flow path through the heat exchanger block. The heat exchanger block can be used as an evaporator in a motor vehicle air-conditioning system.

18 Claims, 2 Drawing Sheets

HEAT EXCHANGER TUBE BLOCK WITH MULTICHAMBER FLAT TUBES

CROSS-REFERENCE TO RELATED APPLICATION

This application is a continuation of pending PCT Patent Application No. PCT/DE99/02128, filed Jul. 9, 1999. German patent number DE19833845A1, to which priority is claimed, issued Feb. 3, 2000.

1. Field of the Invention

The present invention relates to a heat exchanger tube block and to a multichamber flat tube that can be used for such a tube block.

2. Background of the Invention

A heat-exchanger tube block of the generic type is shown in the German patent document DE 39 36 106 A1. The tube block is built up from single-chamber flat tubes that are bent around in a U-shape once, or several times in meanders, by 180° in the plane of their transverse and longitudinal extent and are stacked one above the other in the direction at right angles to these former directions, with the introduction of corrugated ribs between them. Depending on the number of flat-tube windings, the tube block therefore consists of two or more block units located one behind the other in the block depth (front to back) direction, each of which block units includes a stack of straight, flat-tube sections with parallel flow through them. Neighboring block units are in series fluid connection by means of the lateral U-bends in the flat tubes. The two ends of each flat tube open, on the same side of the block, into one associated collector duct extending along the block height direction, the two collector ducts being formed from one longitudinally divided collector box or two separated collector tubes.

SUMMARY OF THE INVENTION

The present invention concerns a tube block that includes a plurality of block units composed in each case of a plurality of tube units located one above the other in stack form, the stacking direction defining a block height direction and the flow ducts formed by the tube units extending in a block transverse direction at right angles to it. The block units are arranged one behind the other in the block depth (front to back) direction at right angles to the block height direction and the block transverse direction. The tube units emerge into collector ducts that are arranged so that they extend at the sides of the tube block in the block height direction, i.e. with the longitudinal centerline parallel to it. In the present case, the term "collector ducts" is uniformly employed, for simplicity, for all ducts into which the tube units emerge, the concept involving collector ducts in the actual sense, in which the medium led in parallel through a plurality of tube units is collected for the purpose of removal from the tube block, and involving distributor ducts, in which the medium supplied to the tube block is distributed among a plurality of emerging tube units, and also involving reversal ducts in which the medium is deflected from a first group of emerging tube units into a second group of emerging tube units.

In use, a first medium flows through the tube block whereas a second medium, which has to be brought into thermal contact with the first medium, is channeled over the tube block in the block depth (front to back) direction with external flow onto the tube-block surfaces. Heat exchangers with such tube blocks are employed, for example, as evaporators and condensers in motor vehicle air-conditioning systems. The tube block is usually supplemented, in order to form a tube/rib block, by the introduction of heat-conducting corrugated ribs between the tube units. The tube units can, for example, be formed by flat tubes.

The present invention is based, as a technical problem, on the provision of a heat-exchanger tube block of the type described above, by means of which a heat exchanger with high heat transfer capability and a high level of pressure resistance is achieved with a relatively small filling quantity and with the possibility of variable guidance of the tempering medium led through it, and is based on a multichamber flat tube which is particularly suitable for the construction of such a tube block.

The invention solves this problem by providing a heat exchanger tube block and a multichamber flat tube with the following features.

In the heat exchanger tube block, at least one collector duct connection is provided between at least two neighboring block units, which collector duct connection connects one collector duct of one block unit directly to a collector duct of the other block unit. Here, the term "direct" means that the relevant collector ducts are in connection by means of a corresponding fluid connection extending in the block depth (front to back) direction and not, or at least not only, by means of one or a plurality of the tube units of the block. By means of this one or preferably a plurality of direct fluid connections of the collector ducts arranged at the sides of the tube block, it is possible to realize a very variable flow guidance of the medium led through the system, for example a refrigerant of an air-conditioning system, which flow guidance is matched to the particular application. The plurality of block units which are located one behind the other in the block depth (front to back) direction and therefore in the flow direction of the other medium channeled over the tube block, makes it possible to achieve a high heat transfer capability for the tube block. The tube block can be built up from extruded flat tubes having ducts optimized with respect to low filling quantity, i.e. low volumes flowing through the tube block, and high pressure resistance. The collector ducts arranged at the sides of the tube block can be formed from highly pressure-resistant collector tubes of relatively small cross section, in particular where correspondingly narrow flat-tube units are used or where units of this type are used which have flat-tube ends rotated out of the transverse plane relative to the collector duct longitudinal direction.

In a tube block developed in accordance with the present invention, direct collector duct connections are provided between each pair of neighboring block units in such a way that the associated tempering medium flows through the block units in series.

In a tube block developed in accordance with the present invention, a collector space, which is formed for example by a collector tube or a collector box, is subdivided by transverse partitions into a plurality of collector ducts. This makes it possible to achieve a serpentine form of flow through a respective block unit deflected once or a plurality of times.

In a tube block developed in accordance with the present invention, the collector ducts on at least one side of the block are formed from individual collector tubes, respectively associated with a block unit, which collector tubes are at a distance apart in the block depth (front to back) direction, which, for example, facilitates the drainage of condensate water when used in an evaporator. The distance apart is produced by one or a plurality of distance elements, which are formed on the collector tubes or are attached to the latter.

In further embodiments, the distance element includes a shaped sheet-metal piece or tubular piece with at least one slot opening or includes an outwardly bulged passage on a collector tube. The distance elements configured in this way keep the collector tubes at a distance apart and simultaneously define a respective collector tube connection. In yet a further embodiment of the invention, the distance element can consist of two fluid-tight mutually abutting or mutually engaging passages, at least one of the two passages being bulged outward.

In a developed tube block in accordance with the present invention, the tube units are formed from straight flat-tube sections, which emerge with twisted tube ends into the collector tubes. Because of the twisting at the ends, the flat-tube ends are rotated out of the transverse plane of the collector tubes, which makes it possible to use collector tubes with an internal diameter smaller than the flat-tube width, so that the internal volume of the tube block can be kept small.

A tube block developed in accordance with the present invention is complemented by a tube/rib block. In this arrangement, a single corrugated rib can be introduced for each corrugated rib layer, the width of the corrugated rib corresponding essentially to the total block depth (front to back), or a plurality of corrugated ribs are provided adjacent to one another, it being possible for these to have the same or different width and structure.

In a tube block developed in accordance with the present invention, at least two tube units, located adjacent to one another in the block depth (front to back) direction, are realized as integral parts of a single-piece multichamber flat tube, the latter extending in the width over a corresponding number of block units.

The multichamber flat tube in accordance with the present invention is particularly suitable for building up the tube block just described. It is subdivided at the ends by one or a plurality of longitudinal slots into a plurality of separate end segments which are each twisted about its own longitudinal centerline. In the case of a tube block built up of such flat tubes, the end segments of each flat tube end region are then individually associated with the corresponding block units, so that the chambers of each flat tube are subdivided in groups among the corresponding block units, the respective chambers which emerge from one end segment being associated with one block unit.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
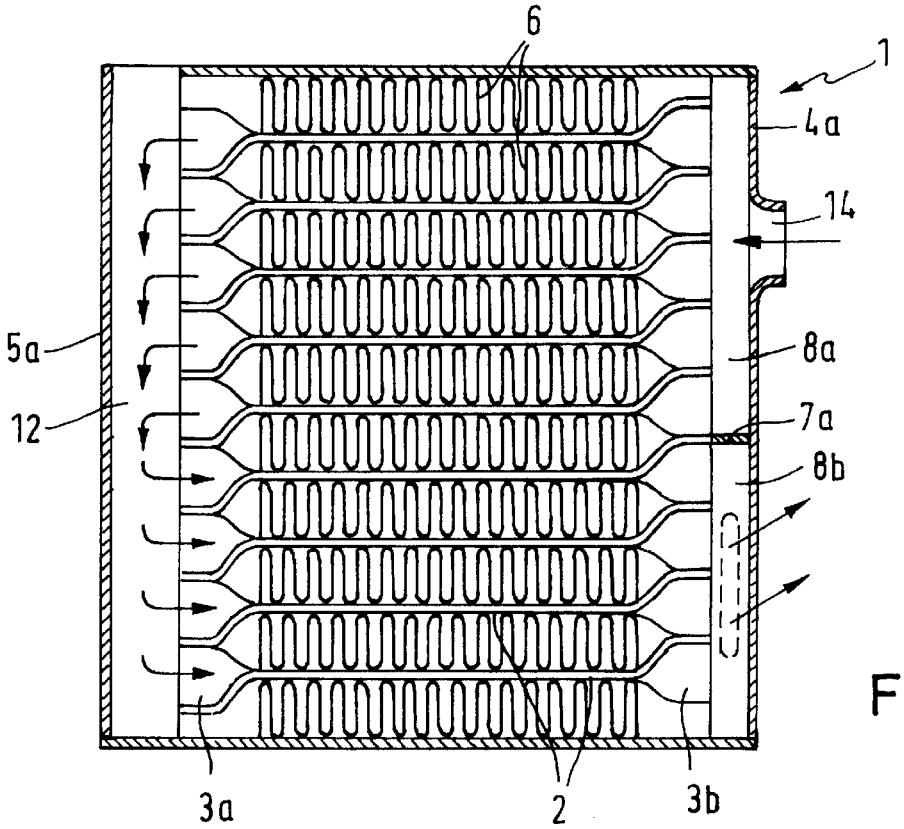
FIG. 1 is a schematic front elevation view of one of a plurality of block units of a tube/rib block for an evaporator of an air-conditioning system in accordance with the present invention.

FIG. 1 shows a tube-block unit 1, of which a plurality are arranged in the block depth (front to back) direction, i.e. located one behind the other at right angles to the plane of the drawing, and which form, by this means, a tube/rib block that can be used, for example, as a parallel-flow evaporator with variable refrigerant guidance in a motor vehicle air-conditioning system. The respective block unit 1 includes a stack of multichamber flat tube units 2 in sequence in the block height direction, i.e. stacked one above the other. The chambers, i.e. flow ducts, of the flat tube units 2 extend in the block transverse direction, i.e. at right angles to the block depth (front to back) and block height directions. In their end regions 3*a* and 3*b*, the flat tube units 2, which otherwise lie in planes at right angles to the block height direction, are twisted by a specifiable torsion angle about their longitudinal centerline or, alternatively, about a centerline parallel to it. The torsion angle can be arbitrarily selected between 0° and 90°, a twist of 90° being selected as an example in FIG. 1. Heat-conducting corrugated ribs 6 are introduced between the flat tube units 2.

The twisted ends 3*a* and 3*b* of the flat tube units 2 extend into respective collector tubes 4*a* and 5*a*, which tubes are provided at opposite sides of the tube blocks and are arranged with the longitudinal centerline parallel to the block height direction. In this arrangement, the flat tube ends, 3*a* and 3*b*, are introduced in a fluid-tight manner into corresponding slots in the collector tubes 4*a* and 5*a*. In the case of tube ends twisted by 90°, these longitudinal slots extend parallel to the collector tube longitudinal centerline and this permits the use of collector tubes 4*a* and 5*a* of particularly small internal diameter. This is because, in the extreme case, this diameter then only needs to be a little larger than the thickness of the flat-tube units 2. Depending on the requirement, the longitudinal slots formed in the respective collector tubes 4*a* and 5*a* are separated by one another by narrow webs or are combined to form a continuous longitudinal slot.

Figure 2:
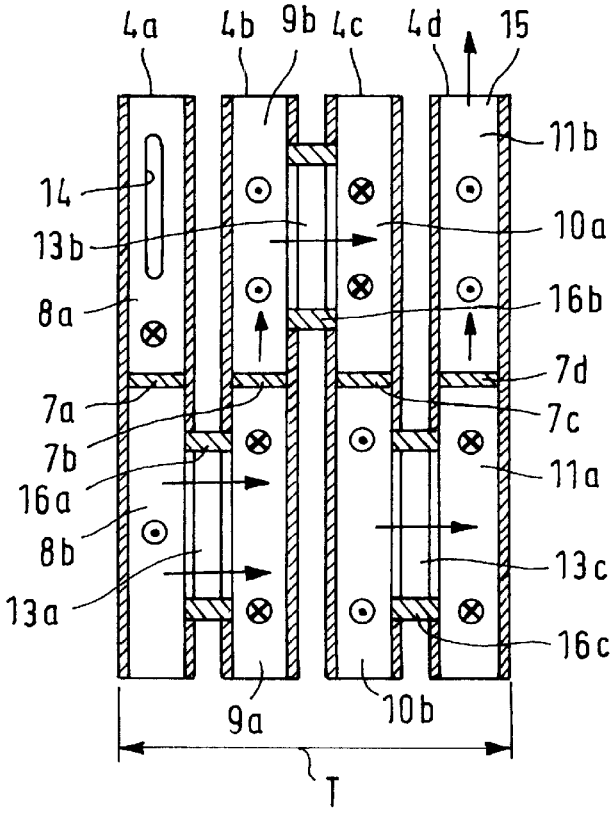
FIG. 2 is a schematic side elevation view of a lateral collector tube arrangement of the tube/rib block of FIG. 1.

FIG. 2 shows an arrangement of four adjacent collector tubes 4*a*, 4*b*, 4*c* and 4*d* located parallel to one another in the block depth (front to back) direction, such as are provided on the right-hand side of the tube block in FIG. 1 for the case, assumed as an example, where the tube block is built up of four block units 1 located one behind the other. On the opposite side of the tube block, four collector tubes are then likewise correspondingly arranged. For the flow direction selected in FIGS. 1 and 2, and illustrated by the flow arrows, the side represented in FIG. 2 forms the connection side of the tube block, the medium led through the tube block being supplied to the left-hand collector tube 4*a* in FIG. 2 and led away again from the right-hand collector tube 4*d* shown in FIG. 2. It is obvious that, as an alternative, the opposite flow direction is possible. The collector tubes 4*a* to 4*d* shown in FIG. 2 are respectively subdivided by an associated transverse partition 7*a* to 7*d* into two separated collector ducts 8*a*, 8*b*; 9*a*, 9*b*; 10*a*, 10*b*; and 11*a*, 11*b* respectively. In contrast, the opposite collector tubes are not divided and therefore form a single collector duct 12, as is illustrated by the left-hand collector tube 5*a* in FIG. 1. As a result, the undivided collector tubes on the left-hand side of the block in FIG. 1 function as reversal tubes which deflect the flow medium from one portion of the flat-tube units, which emerge in parallel at the opposite end into one collector duct 8*a*, into the other portion of the flat-tube units, which emerge into the other collector duct 8*b* at the opposite end. This flow behavior can likewise be seen in FIG. 1.

In order to lead the flow medium on from one block unit to a next block unit, i.e. to connect the block units in series with respect to flow, a collector-duct connection 13*a*, 13*b*, 13*c*, in which a direct fluid connection is created in the block depth (front to back) direction between the associated flow ducts, is provided between each two adjacent collector tubes of the four collector tubes 4*a* to 4*d* of FIG. 2. As may be seen in FIG. 2, the collector-duct connections 13*a* to 13*c* are then arranged alternately in such a way that one of the two collector ducts of each inner collector tube 4*b*, 4*c* is connected to the neighboring collector duct of a collector tube adjacent on one side and the other is connected to the neighboring collector duct of a collector tube adjacent on the other side. In this way, the tempering medium is led in series through the block units located one behind the other so that it flows through each block unit in the form of a meander.

In the flow path shown in FIGS. 1 and 2, the tempering medium passes via a lateral inlet opening 14, into the associated collector duct 8*a* of the end collector tube 4*a*. This collector duct 8*a* functions as a distributor that distributes the medium between the first portion of parallel flat tube units 2 of the relevant block unit 1 emerging into it. After flowing through this group of flat tube units 2, the medium passes into the opposite collector or reversal tube 5*a*, where it is deflected into the remaining portion of the flat tube units 2 of this block unit 1, so that it flows through these flat tube units into the other collector duct 8*b* of the inlet end collector tube 4*a*. From there, the medium is led on via the corresponding collector-duct connection 13*a* into the neighboring collector duct 9*a* of the adjacent collector tube 4*b* and, therefore, to the next block unit. As may be seen from FIGS. 1 and 2, it flows through this block unit in the opposite direction to the flow through the first, inlet-end block unit. The through-flow directions are additionally illustrated in FIG. 2 by circles with crosses (which are usual for this purpose) being drawn in those collector ducts in which the tempering medium is flowing into the plane of the drawing whereas, in the other collector ducts which act as collectors and into which the medium flows out of the plane of the drawing, circles with dots (which are usual for this purpose) are drawn. After flowing through the second block unit, the medium therefore passes into the collecting collector duct 9*b* of this block unit and is led on from there to the distributing, neighboring collector duct 10*a* via the corresponding collector-duct connection 13*b* to the next block unit. As may be seen, flow then takes place through this third block unit again in the same direction as the first block unit. From its collecting collector duct 10*b*, the medium passes via the associated collector-duct connection 13*c* to the fourth block unit, through which flow again takes place in the same manner as in the second block unit. From the collecting collector duct 11*b* of the fourth block unit, the tempering medium is then led away from the tube block via an end-face outlet 15 shown in FIG. 2.

It is obvious that, as an alternative to this example shown, it is also possible to connect more than four block units or less than four block units in series in the manner described. It is, furthermore, obvious that the arrangement and positioning of inlet opening and outlet opening can be arbitrarily modified relative to the example shown in order to supply the tempering medium to the tube block and to remove it from there again in a manner best suited to the particular application. As a further alternative, additional transverse partitions can be provided in the collector tubes on both sides of the respective block unit in order to lead the tempering medium through the block unit in the form of a meander with a plurality of reversals of direction. A further modification consists in the inlet opening and the outlet opening not being provided at the same sides of the tube block, as shown, but at opposite sides of the tube block.

Figure 3:
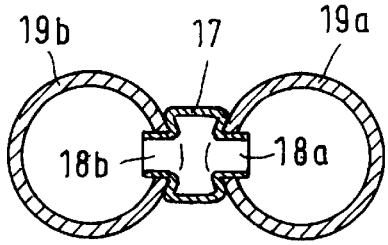
FIG. 3 is a cross-sectional view of a first embodiment of direct fluid connections between collector ducts of the collector tubes shown in FIG. 2.

As is indicated in FIG. 2, the collector tubes 4*a* to 4*d* are arranged at a distance from one another at the respective side of the tube block, which facilitates the condensate water drainage in the case, for example, of employment as evaporator. This is achieved by means of distance or spacing elements 16*a*, 16*b*, 16*c*, which provide, at the same time, the direct collector-duct fluid connections 13*a*, 13*b*, 13*c*. Various embodiments of these connections are represented in FIGS. 3 to 6. In the example of FIG. 3, a suitably shaped tubular sleeve 17 is provided as the distance element. This tubular sleeve 17 is provided with longitudinal slots 18*a*, 18*b* at two radially opposite positions on the periphery. The slot edges of the longitudinal slots 18*a*, 18*b* form connecting pieces that are introduced in a fluid-tight manner into corresponding longitudinal slots of two collector tubes 19*a*, 19*b* that are to be connected. The tubular sleeve 17, which forms a tubular transition piece in this way, is closed at the ends and fixes the two fluid-connected collector tubes 19*a*, 19*b* at the desired distance apart.

Figure 4:
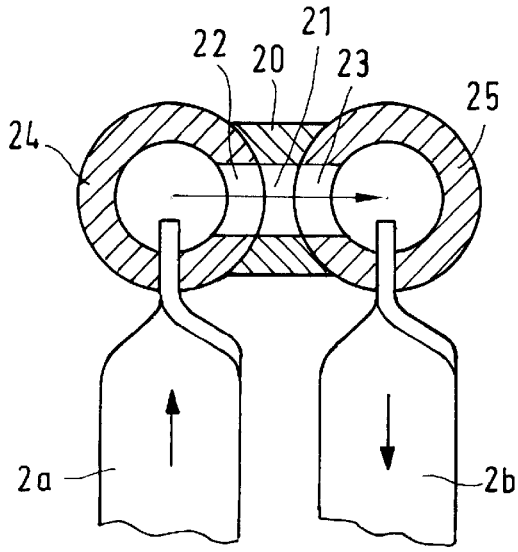
FIG. 4 is a cross-sectional view of a second embodiment of the collector duct connections.

A suitably shaped, solder-plated sheet-metal piece 20 is used as the distance element in the example of FIG. 4. An opening 21 is formed in the piece 20 which, together with longitudinal slots 22, 23 of adjacent collector tubes 24, 25, form a through fluid connection between the collector ducts defined by the collector tubes 24, 25. Also shown in FIG. 4 are two flat tubes 2*a*, 2*b* of neighboring tube block units 1, that are introduced in a fluid-tight manner, by means of tube ends twisted at a right-angle, into corresponding longitudinal slots in the collector tubes 24, 25. As is indicated by corresponding flow arrows, the tempering medium flows from the flat tube 2*a* and, if appropriate, from further, parallel flat tubes of the same block unit, into the collector duct of the associated collector tube 24 and is led via the direct collector-duct connection into the collector duct of the neighboring collector tube 25 and then distributed into the flat tubes 26, which emerge there, of the next tube block unit.

The attachment of the solder-plated sheet-metal piece 20 to the collector tubes 24, 25 is by a suitable soldering process, the previous solder-plating having possibly taken place in accordance with some conventional process, for example electrical galvanizing or the so-called CD process. It is then possible to provide a common soldering process both for connecting the distance elements 20 to the collector tubes 24, 25 and for the fluid-tight connection of the flat-tube units to the collector tubes 24, 25, for which purpose the flat tubes and/or the collector tubes are likewise prefabricated as solder-plated parts and provided with flux. As an alternative, unplated collector tubes 24, 25 can be used and separate, shaped solder parts introduced at the connection locations. The fluid-connecting collector tubes 24, 25 are also held at a desired distance apart in the case of the distance elements 20 used in the example of FIG. 4.

Figure 5:
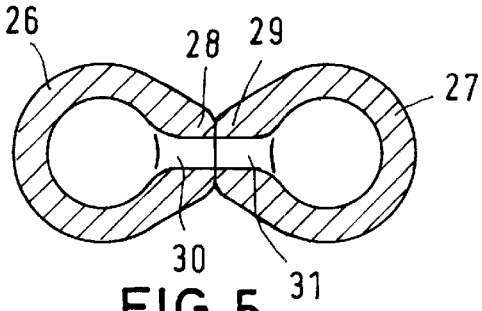
FIG. 5 is a cross-sectional view of a third embodiment of the collector duct connections.
Figure 6:
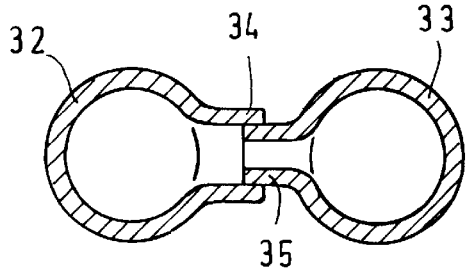
FIG. 6 is a cross-sectional view of a fourth embodiment of the collector duct connections.

FIGS. 5 and 6 show examples in which the distance elements are formed by corresponding bulges on the connected collector tubes themselves. In the embodiment of FIG. 5, collector tubes 26, 27 are used which, at the connection locations, are provided with dome-shaped bulges 28, 29 which surround respective through-openings 30, 31.

The collector tubes 26, 27 to be connected are joined together in a fluid-tight manner with their dome-shaped bulges 28, 29 abutting one another so that, on the one hand, the desired fluid connection is provided there and, on the other hand, the collector tubes 26, 27 are held at a distance apart, as desired, in the region outside the connection location.

In the example of FIG. 6, collector tubes 32, 33, to be connected together, are provided with different dome-shaped bulges 34, 35, which fit into one another and surround the associated through-openings. The narrow bulge is pushed into the corresponding bulge 34 of larger size and is fastened into it in a fluid-tight manner, preferably by means of seal soldering.

During the prefabrication of the required collector tubes in all the examples described above, the slots necessary for introducing the tube units can be generated in one operating cycle together with the slots, i.e. passages, required for the direct collector-duct fluid connection and, if necessary, the associated dome-shaped bulges. The openings for the direct collector-duct fluid connections can have a round or elongated configuration. The two dome-shaped bulges forming a respective collector-duct fluid connection do not both need to bulge outward, as in the examples shown, but rather, as an alternative, one of the two can bulge inward and the other bulge, which points outward, then engages in the inward bulge.

Figure 7:
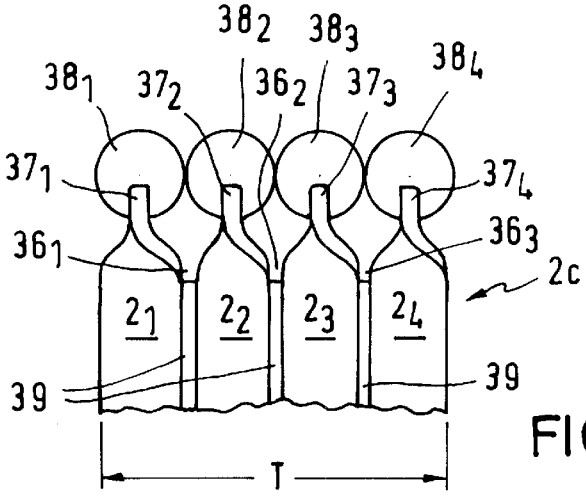
FIG. 7 is a schematic, partial plan view of a multichamber flat tube that can be used for the tube/rib block of FIG. 1.

As is indicated in FIG. 4, the flat-tube units 2 of the tube/rib block of FIG. 1 can consist of individual flat tubes 2*a*, 2*b* for each block unit 1, i.e. each block unit 1 consists, in this case, of a stack of individual flat tubes whose width essentially corresponds to the depth (front to back) of the respective block unit. As an alternative, a wider flat tube type can be used in a manner such as is illustrated diagrammatically in FIG. 7. The multichamber flat tube 2*c* shown there has a width "T" which essentially corresponds to the total tube-block depth (front to back), i.e. the sum of the depths (front to back) of the individual block units. In both end regions, of which one is represented in FIG. 7, the flat tube 2*c* is provided with a specifiable number "n" of longitudinally extending slots such as saw-cuts $\mathbf{36}_1$, $\mathbf{36}_2$, $\mathbf{36}_3$, i.e. n=3 cuts are provided in this example, so that the end region is subdivided into a number n+1 of end segments $\mathbf{37}_1$ to $\mathbf{37}_4$, i.e. of four segments in the case shown. Each end segment $\mathbf{37}_1$ to $\mathbf{37}_4$ is respectively twisted by 90° about its own longitudinal centerline; as an alternative, a different torsion angle, which is greater than 0° and smaller than 90°, can be selected. In the case of the right-angled twisting, the end segments $\mathbf{37}_1$ to $\mathbf{37}_4$ extend, at their end, parallel to the block height direction, i.e. to the longitudinal direction of the associated collector tubes $\mathbf{38}_1$, $\mathbf{38}_2$, $\mathbf{38}_3$, $\mathbf{38}_4$, which are provided with corresponding longitudinal slots into which the end segments $\mathbf{37}_1$ to $\mathbf{37}_4$ are introduced. In this way, the flat tube 2*c* is subdivided, with respect to flow, into a corresponding number "n" of flat-tube lanes $\mathbf{2}_1$, $\mathbf{2}_2$, $\mathbf{2}_3$, $\mathbf{2}_4$ which are respectively associated with one of the block units located one behind the other in the block depth (front to back) direction and which contain chambers of the flat tube 2*c* forming an associated sub-group of all the flow ducts. Whereas, in the example of FIG. 7, the flat tube 2*c* is subdivided into partial lanes $\mathbf{2}_1$ to $\mathbf{2}_4$ of the same width, it is possible, as an alternative, to provide a subdivision into partial lanes of different widths. In the example of FIG. 7, an open flow duct 39 remains in each case between two neighboring flat tube parts because this flow duct 39 is shortened at the ends by the slots or saw-cuts $\mathbf{36}_1$, $\mathbf{36}_2$, $\mathbf{36}_3$ selected to be correspondingly wide and therefore does not function as a fluid-carrying duct which emerges into the collector tubes. If, as an alternative, the saw-cuts are introduced as narrow cuts between neighboring ducts, all the chambers of the flat tube 2*c* can, if necessary, function as fluid-carrying flow ducts.

The multichamber flat tube 2*c* is preferably fabricated as an extruded section with ducts optimized with respect to low internal volume and high pressure resistance. The fact that, particularly in the case of flat tubes with twisted ends, collector tubes with a relatively small internal diameter can be used for the tube block also, as mentioned, contributes to achieving a low internal volume and a high pressure resistance of the tube/rib block overall. In addition, a very variable flow guidance system can be achieved for the tempering medium led through the system, depending on the positioning of the direct collector-duct connections between the collector tubes and/or the transverse partitions in the collector tubes.

The corrugated rib structure 6 of the tube/rib block can be formed by introducing, per rib layer, a corrugated rib extending over the whole of the block depth (front to back) or a plurality of narrower corrugated ribs of the same or different width adjacent to one another. Thus, as an example, a wide corrugated rib extending over three block units and a narrow corrugated rib limited to the fourth block unit can be provided or one narrow and one wide corrugated rib can be provided alternately. The different possibilities for introducing the corrugated ribs 6 depend on whether the wide flat tube 2*c* of FIG. 7 is provided for the tube block or a plurality of flat tubes located adjacent to one another in the block depth (front to back) direction are provided.

The tube block according to the invention is, inter alia, particularly suitable for evaporators of motor vehicle air-conditioning systems operating with the $CO_2$ refrigerant because this tube block is sufficiently pressure-resistant and has a comparatively small internal volume, further realizations in addition to those already mentioned being possible. As an example, collector tubes without transverse partitions can be provided, i.e. flow takes place in parallel through all the tube units of a block unit. The collector-duct connections are, in this case, arranged alternately on one and the other collector-duct side of the tube block. As a further variant, the collector-duct connections can be formed by reversal tubes that deflect the through-flowing medium from tube units of one block unit into the tube units of at least one neighboring block unit. For this purpose, these tube units of the participating block units emerge into a common reversal space, which is formed by the reversal tube, which therefore comprises, in an integrated manner, the connected collector ducts of these block units.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A heat exchanger block comprising:

a plurality of tube block units positioned one behind the other in a block depth direction from a front to a back of the heat exchanger block, each said tube block unit including a plurality of tube units stacked one above the other in a block height direction from a bottom to a top of the heat exchanger block, said tube units each having a plurality of flow ducts extending transverse to said block depth and height directions and being fluid flow connected at at least one end to at least two collector ducts extending in said block height direction;

at least one collector-duct connection extending between at least two adjacent ones of said block units, said one collector-duct connection fluid flow connecting one of said collector ducts of one of said two adjacent block units directly to one of said collector ducts of another of said two adjacent block units; and at least one collector-duct connection extending between each other pair of adjacent ones of said block units to provide a series fluid flow path through said block units.

2. The heat exchanger block according to claim 1 wherein said at least two collector ducts are separated from one another by a transverse partition.

3. The heat exchanger block according to claim 1 wherein said tube units of each said block unit are fluid flow connected to an associated collector tube, adjacent ones of said collector tubes being spaced apart by a distance element.

4. The heat exchanger block according to claim 3 wherein said distance element is one of a shaped sheet-metal piece and a tubular piece having at least one opening formed therein providing said one collector-duct connection.

5. The heat exchanger block according to claim 3 wherein said distance element includes an outwardly bulged opening on at least one of said adjacent collector tubes providing said one collector-duct connection.

6. The heat exchanger block according to claim 3 wherein said distance element includes a pair of fluid-tight, mutually abutting bulges each having a through-opening forming said one collector-duct connection.

7. The heat exchanger block according to claim 3 wherein said distance element includes a pair of fluid-tight, mutually engaging bulges each having a through-opening forming said one the collector-duct connection.

8. The heat exchanger block according to claim 1 wherein said tube units are formed from straight flat-tube units joined at twisted tube ends to a pair of spaced collector tubes, said twisted tube ends engaging corresponding slots formed in said collector tubes, said collector tubes forming said collector ducts.

9. The heat exchanger block according to claim 1 including a heat-conducting corrugated rib positioned between each adjacent pair of said tube units in said block height direction, each said corrugated rib extending over said block depth.

10. The heat exchanger block according to claim 1 including at least two adjacent corrugated ribs positioned between each adjacent pair of said tube units in said block height direction, said corrugated ribs extending over said block depth.

11. The heat exchanger block according to claim 1 wherein at least two of said tube units, located adjacent to one another in said block depth direction, are formed from an integral multichamber flat tube.

12. The heat exchanger block according to claim 11 wherein said multichamber flat tube is subdivided at each of opposite ends by at least one longitudinal slot into at least two separate end segments each twisted about its own longitudinal centerline.

13. A heat exchanger block comprising:

a plurality of tube block units positioned one behind the other in a block depth direction from a front to a back of the heat exchanger block, each said tube block unit including a plurality of tube units stacked one above the other in a block height direction from a bottom to a top of the heat exchanger block, said tube units each having a plurality of flow ducts extending transverse to said block depth and height directions and being fluid flow connected at at least one end to at least two collector ducts extending in said block height direction, wherein fluid flow in at least one of said flow ducts is in a first flow direction and fluid flow in at least one other of said flow ducts is in a second flow direction different from said first flow direction; and at least one collector-duct connection extending between at least two adjacent ones of said block units, said one collector-duct connection fluid flow connecting one of said collector ducts of one of said two adjacent block units directly to one of said collector ducts of another of said two adjacent block units.

14. The heat exchanger block according to claim 13 including at least one collector-duct connection extending between each other pair of adjacent ones of said block units to provide a series fluid flow path through said block units.

15. The heat exchanger block according to claim 13 wherein said at least two collector ducts are separated from one another by a transverse partition.

16. The heat exchanger block according to claim 13 wherein said tube units of each said block unit are fluid flow connected to an associated collector tube, adjacent ones of said collector tubes being spaced apart by a distance element.

17. The heat exchanger block according to claim 13 wherein at least two of said tube units, located adjacent to one another in said block depth direction, are formed from an integral multichamber flat tube.

18. The heat exchanger block according to claim 17 wherein said multichamber flat tube is subdivided at each of opposite ends by at least one longitudinal slot into at least two separate end segments each twisted about its own longitudinal centerline.

* * * * *